US010479467B2

(12) United States Patent
McCall et al.

(10) Patent No.: US 10,479,467 B2
(45) Date of Patent: Nov. 19, 2019

(54) MOUNTING AND PROPULSION SYSTEM FOR BOATS

(71) Applicant: Meg McCall, San Luis Obispo, CA (US)

(72) Inventors: Meg McCall, San Luis Obispo, CA (US); James Van Gompel, Angola, IN (US)

(73) Assignee: Meg McCall, San Luis Obispo, CA (US)

( * ) Notice: Subject to any disclaimer, the term of this patent is extended or adjusted under 35 U.S.C. 154(b) by 0 days.

(21) Appl. No.: 16/035,426

(22) Filed: Jul. 13, 2018

(65) Prior Publication Data

US 2019/0016428 A1 Jan. 17, 2019

Related U.S. Application Data

(60) Provisional application No. 62/532,898, filed on Jul. 14, 2017.

(51) Int. Cl.

| | |
|---|---|
| ***B63H 16/04*** | (2006.01) |
| ***B63H 16/06*** | (2006.01) |
| *B63B 35/71* | (2006.01) |

(52) U.S. Cl.

CPC ..... *B63H 16/06* (2013.01); *B63H 16/04* (2013.01); *B63B 2035/715* (2013.01); *B63H 2016/046* (2013.01)

(58) Field of Classification Search

CPC ..... B63H 16/06; B63H 2016/063; B63H 16/073; B63B 2035/715; B63B 7/08; B63B 7/082; B63B 7/085; B63B 7/087

See application file for complete search history.

(56) References Cited

U.S. PATENT DOCUMENTS

| | | | | |
|---|---|---|---|---|
| 468,960 | A | 2/1892 | Vondersaare | |
| 2,083,004 | A | 6/1937 | Haskell | |
| 3,593,684 | A * | 7/1971 | Cogliano | B63B 1/121 114/39.28 |
| 3,677,216 | A | 7/1972 | Gentemann | |
| 4,679,516 | A | 7/1987 | Friesen | |
| 4,820,216 | A | 4/1989 | Masters | |
| 5,127,859 | A | 7/1992 | Rantilla | |
| 5,851,132 | A | 12/1998 | Merrill | |
| 6,022,255 | A | 2/2000 | Lukanovich | |
| 6,101,678 | A | 8/2000 | Malloy | |

(Continued)

OTHER PUBLICATIONS

Non-final office action from U.S. Appl. No. 13/839,452 dated Jul. 21, 2014.

(Continued)

*Primary Examiner* — Andrew Polay

(74) *Attorney, Agent, or Firm* — Fitch, Even, Tabin & Flannery LLP

(57) ABSTRACT

A paddle mount for a boat is described. The mount includes a generally t-shaped tubular body including a flange and a stem, where the length of the flange and the stem is adjustable and the ends of the flange are configured to rest on opposite sides of the boat cockpit. The mount is configured to couple to the front end of the cockpit and to an end of the stem, such that the t-shaped body may be rotated upwards away from the boat. A mount adapter is also described that may be used to attach a paddle to the boat using the mount.

3 Claims, 20 Drawing Sheets

(56) References Cited

U.S. PATENT DOCUMENTS

| | | | |
|---|---|---|---|
| 6,261,141 | B1 | 7/2001 | Heap |
| 6,544,087 | B1 | 4/2003 | Peng |
| 6,632,111 | B2 | 10/2003 | Oathout |
| 6,796,863 | B1 | 9/2004 | Oathout |
| 7,581,996 | B1 | 9/2009 | Boller |
| 2003/0040234 | A1 | 2/2003 | Oathout |
| 2012/0028519 | A1 | 2/2012 | Rechner |

OTHER PUBLICATIONS

Notice of Allowance from U.S. Appl. No. 13/839,452 dated Apr. 30, 2014.

Notice of Allowance from U.S. Appl. No. 13/839,452 dated Apr. 8, 2014.

Notice of Allowance from U.S. Appl. No. 13/839,452 dated Nov. 7, 2014.

Oberlin; Angola man introduces Angel-Oar; News-Sun, Evening Star, Herald-Republican; TheOutDoorPage.com; Mar. 19, 2009; 1 page; KPC News; Kendalville, IN.

* cited by examiner

MOUNTING AND PROPULSION SYSTEM FOR BOATS

CROSS-REFERENCE TO RELATED APPLICATION

This application claims priority to, and the benefit of, U.S. Provisional Application Ser. No. 62/532,898 filed on Jul. 14, 2017, entitled MOUNTING AND PROPULSION SYSTEM FOR BOATS. The entire contents of the foregoing application are hereby incorporated by reference for all purposes.

BACKGROUND OF THE INVENTION

1. Field of the Invention

The present invention relates generally to mounting systems for boats, and more specifically to mounting systems used for human-powered boat propulsion systems.

2. Discussion of the Related Art

Various systems and processes are known in the art for mounting systems used for human-powered boat propulsion systems.

Kayakers and other boaters exhibit a wide range of skill levels, from the recreational kayaker to the professional competitor. Kayaking enthusiasts pursue their sport in a variety of settings, including creeks, rivers, and the ocean. Each of the settings presents unique challenges to the kayaker.

In order to kayak effectively, it is essential that the kayaker be able to effectively control the kayak with a minimum of effort; this is no less true for the recreational kayaker than it is for the expert. The essential element in kayak control is the kayak paddle. A kayak paddle that the user can easily and efficiently employ will greatly facilitate control of the kayak.

Kayak paddles include a single elongated shaft and two flattened blade portions, which may be either integral with the shaft or coupled thereto. The paddle is usually made of some suitably rigid material such as carbon fiber, wood, aluminum, or plastic. Low weight and sufficient strength to resist the forces imposed upon the paddle are important considerations in the manufacture of paddles.

To use a kayak paddle one grips and supports the shaft with both hands, generally perpendicular to the longitudinal axis of the kayak. A blade is inserted in the water near the side of the boat at a point in front of the user. The blade is then pulled backward approximately parallel to the longitudinal axis of the kayak, by backward pressure exerted through the hand closest to the blade in the water, while forward pressure is exerted through the other hand. When the blade has been pulled back to a point beside or just behind the user, it is removed from the water with an upward motion and the opposite blade is inserted in the water in front of the user.

The sequence of motions is repeated, creating forces that propel the boat forward through the water. Subtle differences in the amount of force applied and the direction in which it is applied with each stroke are used to steer the kayak and keep it on course.

In order to paddle effectively, the kayaker must be able to hold the paddle continuously aloft with both hands while simultaneously twisting, rotating and raising/lowering the blades. This requires some amount of physical strength and coordination.

SUMMARY

A mount for a boat is described. The apparatus may include a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat; and a mount configured to couple to a front portion of the boat and pivotally couple to an end of the stem, whereby the t-shaped body may be rotated upwards away from the boat.

A system for human-powered boat propulsion is described. The system may include a boat and a paddle, the system further comprising a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat; and a mount configured to couple to a front portion of the boat and pivotally couple to an end of the stem, whereby the t-shaped body may be rotated upwards away from the boat.

A method of manufacturing a mount for a boat is described. The method may include providing a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat; and providing a mount configured to couple to a front portion of the boat and pivotally couple to an end of the stem, whereby the t-shaped body may be rotated upwards away from the boat.

A method of using a mount for a boat is described. The method may include using a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat; and using a mount configured to couple to a front portion of the boat and pivotally couple to an end of the stem, whereby the t-shaped body may be rotated upwards away from the boat.

DETAILED DESCRIPTION

Figure 1:
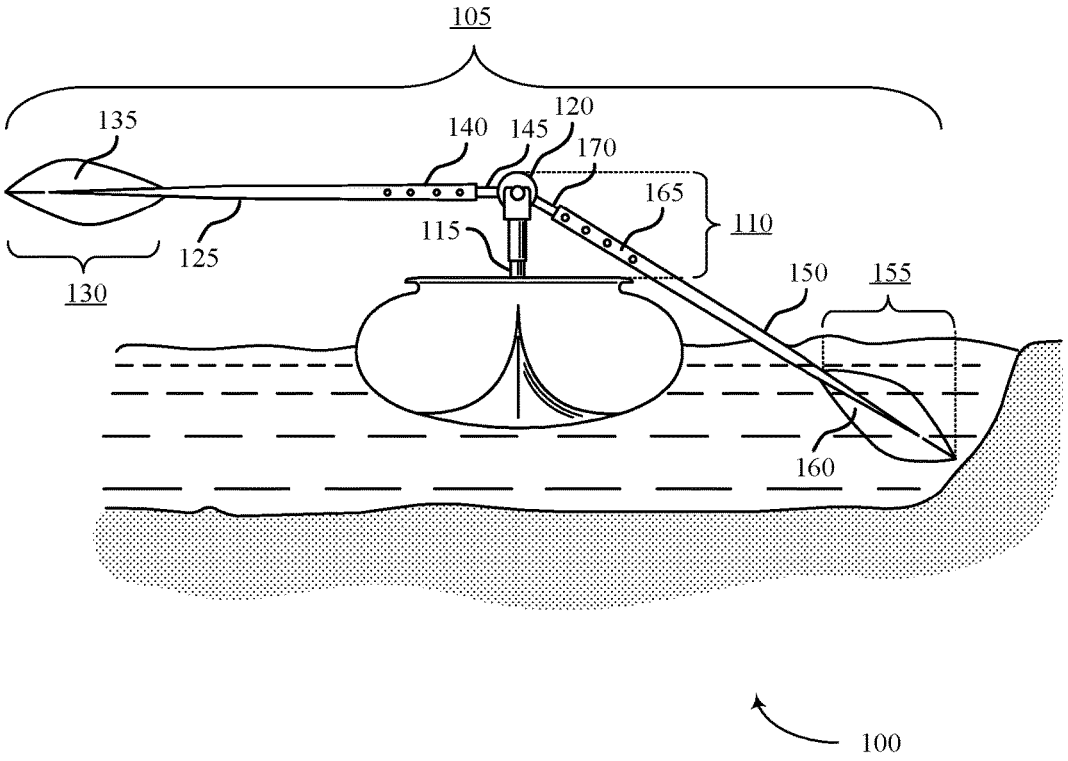
FIG. 1 shows an example of a kayak with an angle oar in accordance with aspects of the present disclosure.

The following description is not to be taken in a limiting sense but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The present invention, in accordance with some embodiments, provides a kayak paddle with a central support that is not found in present day kayaks. Some embodiments further provide for each paddle to be independently adjustable in length. Additional embodiments further provide for each paddle side to be rotatable to multiple (for example, 4) different angles relative to the paddle axis, allowing for the paddle to be adjusted for differing paddling conditions or to be operated with one hand. Some embodiments further provide for paddle blades shaped to allow for paddling in shallow water.

In some variations, embodiments further provide for a paddle support mounting system coupled to the kayak floor. This bottom-mounted (or floor-mounted) support system is angled towards the kayak bow along a longitudinal axis of the kayak and provides for adjustment of the central support vertically and relative to the kayak. Some embodiments further provide for a paddle support system mounted to the underside of the foredeck of the kayak. This top-mounted support system is angled towards the kayak bow along a longitudinal axis of the kayak and provides for adjustment of the central support vertically and longitudinally relative to the kayak. The support system angle automatically angles the kayak paddle blades to provide some bite, advantageously keeping the blade in the water through the stroke. The present embodiments further provide for vertical rods that provide anchorage, kayak stabilization and assistance in entering and exiting any kayak or means of conveyance.

Furthermore, the described features, structures, or characteristics of the invention may be combined in any suitable manner in one or more embodiments. In the following description, numerous specific details are provided, to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

FIG. 1 shows an example of a kayak 100 with an angle oar 105 in accordance with aspects of the present disclosure. The view is looking towards the bow of the kayak 100 with the longitudinal axis being normal to the plane of the page.

The angle oar 105 includes a central support 110 with a clevis 120. A left paddle arm 125 is comprised of a left blade 130, a left outer tube 140 and a left inner tube 145. A right paddle arm 150 is comprised of a right blade 155, a right outer tube 165, and a right inner tube 170. A support post 115 is shown. The support post 115 is anchored to the kayak 100.

Two examples of support post 115 anchorage, the bottom-mounted anchorage and the top-mounted anchorage, are described below. The clevis 120 is coupled to the top of the support post 115. The left blade 130 is coupled to the left end of the left outer tube 140. The right end of the left outer tube 140 is coupled to the left end of the left inner tube 145 with an adjustable connection. The right end of the left inner tube 145 is coupled to the clevis 120 with a connection that allows for rotation about an axis concurrent with the central hub and approximately normal to the longitudinal kayak 100 axis.

The right blade 155 is coupled to the right end of the right outer tube 165. The left end of the right outer tube 165 is attached to the right end of the right inner tube 170 with an adjustable connection as described below. The left end of the right inner tube 170 is coupled to the clevis 120 with a connection that allows for rotation about an axis concurrent with the central hub and approximately normal (e.g., normal or angled slightly forward of normal, e.g., seven degrees forward of normal) to the longitudinal kayak 100 axis (substantially normal to a plane of travel of a kayak 100, e.g., a plane of a surface of water on which the kayak 100 is traveling.

The shape of the left blade 130 face and right blade face 160 are such that the face come to a point that aligns with the left outer tube 140 longitudinal axis and right outer tube 165 longitudinal axis, respectively. An upper half and a lower half of the left blade 130 face and an upper half and a lower half of the right blade face 160 have equal planar areas. The upper half and lower half of the right blade face 160 are juxtaposed on opposite sides of the right outer tube 165 and are coplanar with one another. The upper half and lower half of the left blade 130 face are juxtaposed on opposite sides of the left outer tube 140 and are coplanar with one another.

Kayak 100 may be an example of, or include aspects of, the corresponding elements described with reference to FIG. 11. Kayak 100 may include angle oar 105. Angle oar 105 may be an example of, or include aspects of, the corresponding elements described with reference to FIGS. 2 through 8, and 11.

Angle oar 105 may include central support 110, left paddle arm 125, and right paddle arm 150. Central support 110 may be an example of, or include aspects of, the corresponding elements described with reference to FIGS. 2 through 9. Central support 110 may include support post 115 and clevis 120.

The support post 115 may extend upwards from the stem. Support post 115 may be an example of, or include aspects of, the corresponding elements described with reference to FIGS. 3 through 7, 12, 13, and 17.

Clevis 120 may be an example of, or include aspects of, the corresponding elements described with reference to FIGS. 2 through 8, and 17.

Left paddle arm 125 may be an example of, or include aspects of, the corresponding elements described with reference to FIGS. 2 through 9. Left paddle arm 125 may include left blade 130, left outer tube 140, and left inner tube 145.

Left blade 130 may be an example of, or include aspects of, the corresponding elements described with reference to FIGS. 2 through 6. Left blade 130 may include left blade face 135.

Left outer tube 140 and left inner tube 145 may be an example of, or include aspects of, the corresponding elements described with reference to FIGS. 2 through 9.

Right paddle arm 150 may be an example of, or include aspects of, the corresponding elements described with reference to FIGS. 2 through 9. Right paddle arm 150 may include right blade 155, right outer tube 165, and right inner tube 170.

Right blade 155 may be an example of, or include aspects of, the corresponding elements described with reference to FIGS. 2 through 6. Right blade 155 may include right blade face 160. Right blade face 160 may be an example of, or include aspects of, the corresponding elements described with reference to FIGS. 2 through 6.

Right outer tube 165 and right inner tube 170 may be an example of, or include aspects of, the corresponding elements described with reference to FIGS. 2 through 9.

Figure 2:
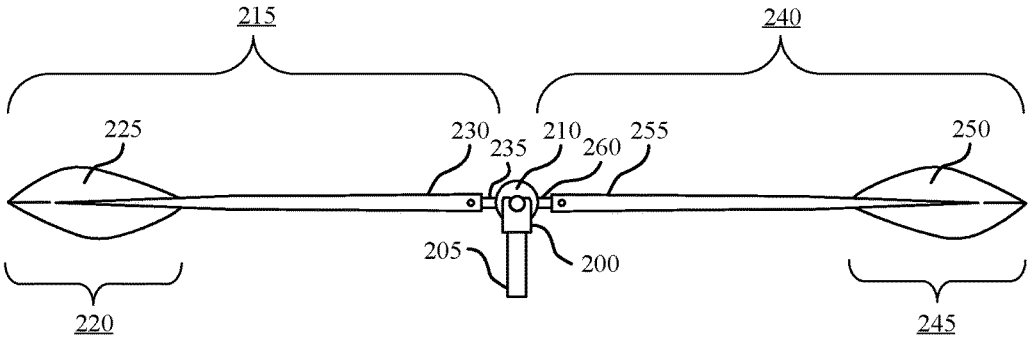
FIG. 2 shows an example of the angle oar adjusted for minimum paddle arm length on each paddle arm and the outer tubes aligned on a straight axis in accordance with aspects of the present disclosure.

FIG. 2 shows an example of the angle oar adjusted for minimum paddle arm length on each paddle arm and the outer tubes aligned on a straight axis in accordance with aspects of the present disclosure. The example shown includes central support 200, left paddle arm 215, and right paddle arm 240. The length of each paddle arm is independently adjustable as described below.

Central support 200 may be an example of, or include aspects of, the corresponding elements described with reference to FIGS. 1, and 3 through 9. Central support 200 may include support post 205 and clevis 210. The support post 205 may extend upwards from the stem.

Left paddle arm 215 may include left blade 220, left outer tube 230, and left inner tube 235. Left blade 220 may include left blade face 225. Right paddle arm 240 may include right blade 245, right outer tube 255, and right inner tube 260. Right blade 245 may include right blade face 250.

Support post 205, clevis 210, left paddle arm 215, left blade 220, left blade face 225, left outer tube 230, left inner tube 235, right paddle arm 240, right blade 245, right blade face 250, right outer tube 255, and right inner tube 260 may be an example of, or include aspects of, the corresponding elements described with reference to FIGS. 1 and 3 through 9.

Figure 3:
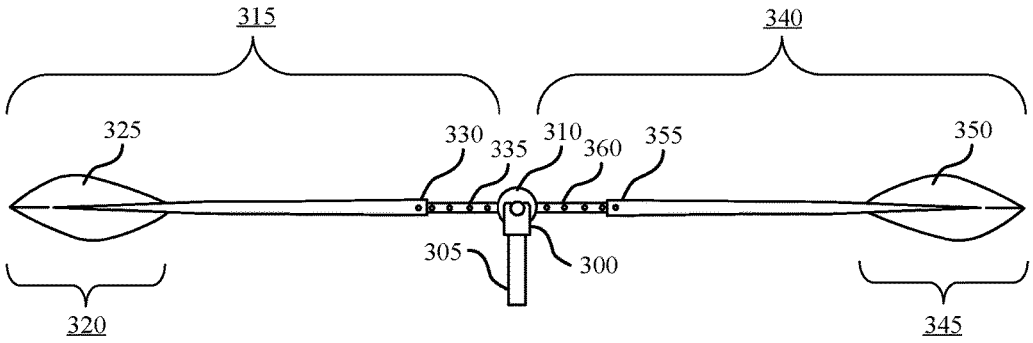
FIG. 3 shows an example of the angle oar adjusted for maximum paddle arm length on each side and the paddle arms aligned on a straight axis in accordance with aspects of the present disclosure.

FIG. 3 shows an example of the angle oar adjusted for maximum paddle arm length on each side and the paddle arms aligned on a straight axis in accordance with aspects of the present disclosure. The example shown includes central support 300, left paddle arm 315, and right paddle arm 340.

Central support 300 may be an example of, or include aspects of, the corresponding elements described with reference to FIGS. 1, 2, and 4 through 9. Central support 300 may include support post 305 and clevis 310. The support post 305 may extend upwards from the stem.

Left paddle arm 315 may include left blade 320, left outer tube 330, and left inner tube 335. Left blade 320 may include left blade face 325. Right paddle arm 340 may include right blade 345, right outer tube 355, and right inner tube 360. Right blade 345 may include right blade face 350.

Support post 305, clevis 310, left paddle arm 315, left blade 320, left blade face 325, left outer tube 330, left inner tube 335, right paddle arm 340, right blade 345, right blade face 350, right outer tube 355, and right inner tube 360 may be an example of, or include aspects of, the corresponding elements described with reference to FIGS. 1, 2, and 4 through 9.

Figure 4:
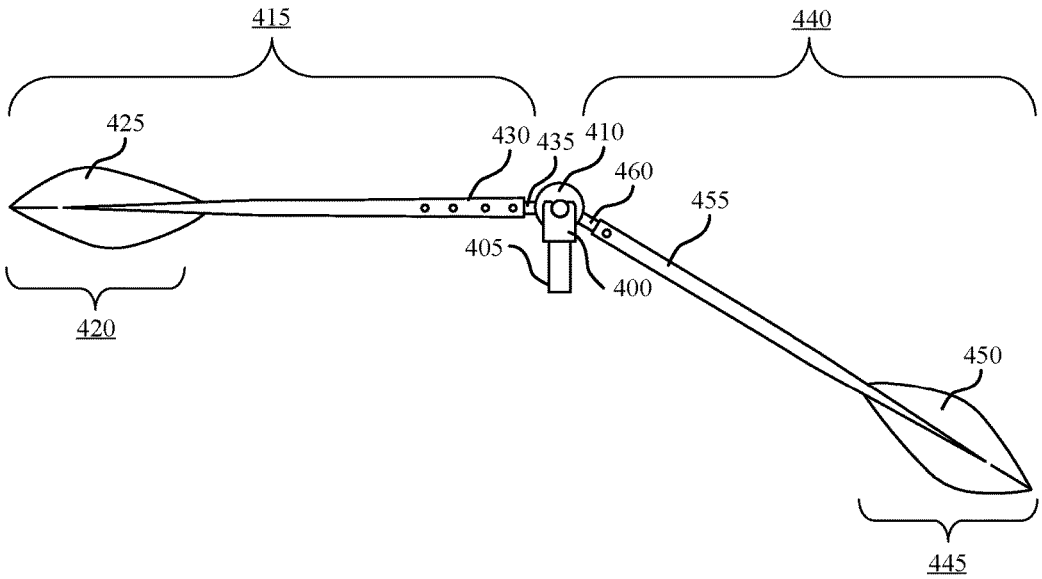
FIG. 4 shows an example of the angle oar adjusted for minimum paddle arm length on each paddle arm and the left paddle arm is rotated clockwise about the central hub in accordance with aspects of the present disclosure.

FIG. 4 shows an example of the angle oar adjusted for minimum paddle arm length on each paddle arm and the left paddle arm 415 is rotated clockwise about the central hub in accordance with aspects of the present disclosure. This may create an angle between the right paddle arm 440 and the left paddle arm 415.

The example shown includes central support 400, left paddle arm 415, and right paddle arm 440. Central support 400 may be an example of, or include aspects of, the corresponding elements described with reference to FIGS. 1 through 3, and 5 through 9. Central support 400 may include support post 405 and clevis 410. The support post 405 may extend upwards from the stem.

Left paddle arm 415 may include left blade 420, left outer tube 430, and left inner tube 435. Left blade 420 may include left blade face 425. Right paddle arm 440 may include right blade 445, right outer tube 455, and right inner tube 460. Right blade 445 may include right blade face 450.

Support post 405, clevis 410, left paddle arm 415, left blade 420, left blade face 425, left outer tube 430, left inner tube 435, right paddle arm 440, right blade 445, right blade face 450, right outer tube 455, and right inner tube 460 may be an example of, or include aspects of, the corresponding elements described with reference to FIGS. 1 through 3, and 5 through 9.

Figure 5:
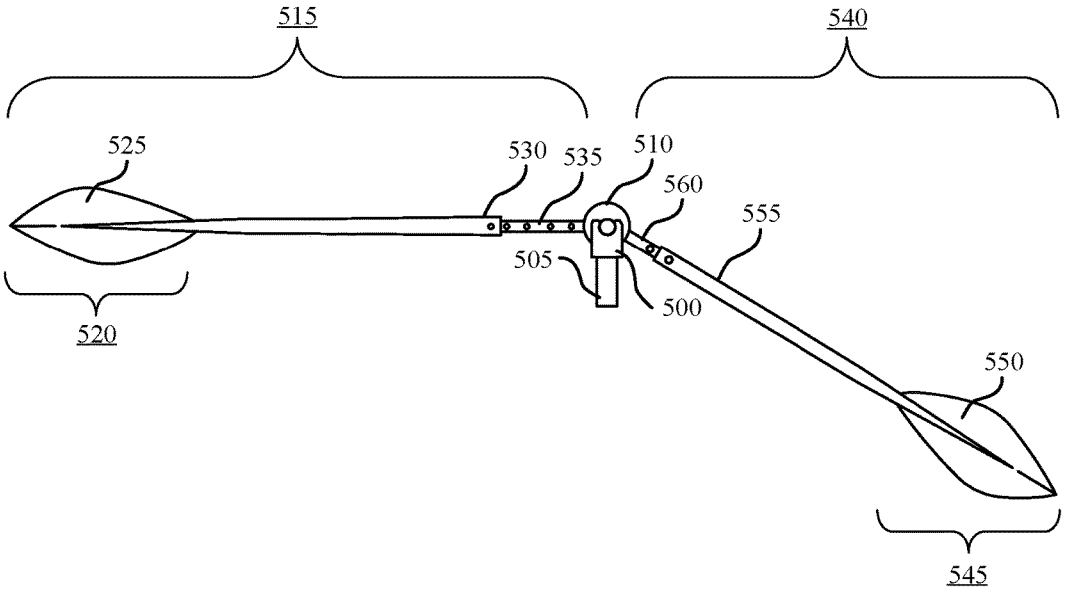
FIG. 5 shows an example of the angle oar adjusted for maximum paddle arm length on the left-hand side and the right paddle arm rotated clockwise in accordance with aspects of the present disclosure.

FIG. 5 shows an example of the angle oar adjusted for maximum paddle arm length on the left-hand side and the right paddle arm 540 rotated clockwise in accordance with aspects of the present disclosure. The example shown includes central support 500, left paddle arm 515, and right paddle arm 540. The right paddle arm 540 is shown adjusted for minimum paddle arm length.

Central support 500 may be an example of, or include aspects of, the corresponding elements described with reference to FIGS. 1 through 4 and 6 through 9. Central support 500 may include support post 505 and clevis 510. The support post 505 may extend upwards from the stem.

Left paddle arm 515 may include left blade 520, left outer tube 530, and left inner tube 535. Left blade 520 may include left blade face 525. Right paddle arm 540 may include right blade 545, right outer tube 555, and right inner tube 560. Right blade 545 may include right blade face 550.

Support post 505, clevis 510, left paddle arm 515, left blade 520, left blade face 525, left outer tube 530, left inner tube 535, right paddle arm 540, right blade 545, right blade face 550, right outer tube 555, and right inner tube 560 may be an example of, or include aspects of, the corresponding elements described with reference to FIGS. 1 through 4 and 6 through 9.

Figure 6:
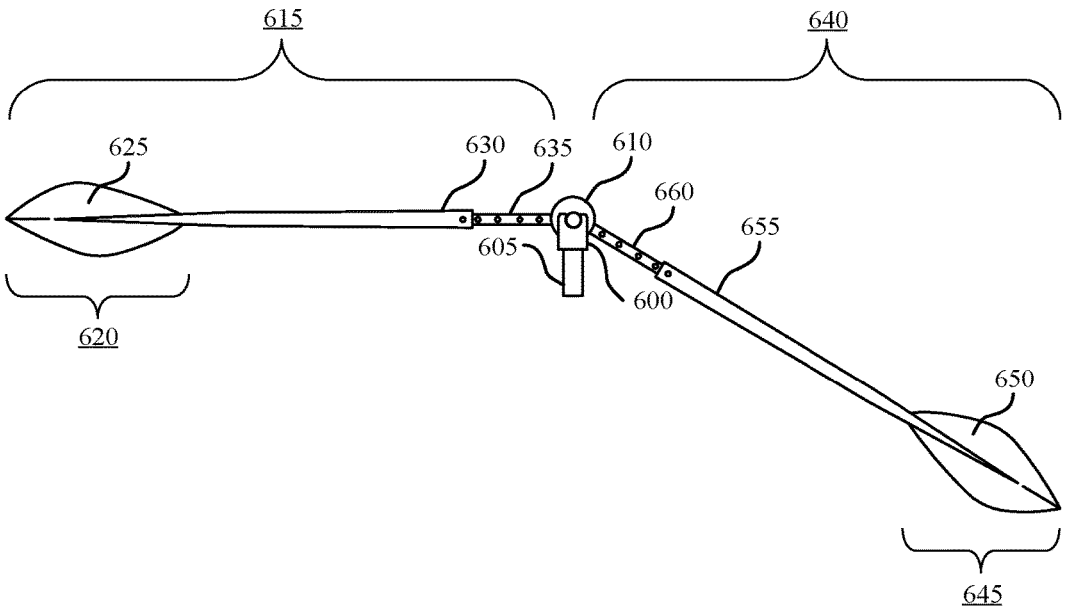
FIG. 6 shows an example of the angle oar adjusted for maximum paddle arm length on each paddle arm and the right paddle arm is rotated clockwise in accordance with aspects of the present disclosure.

FIG. 6 shows an example of the angle oar adjusted for maximum paddle arm length on the left side and the right paddle arm 640 rotated clockwise in accordance with aspects of the present disclosure. The example shown includes central support 600, left paddle arm 615, and right paddle arm 640. The right paddle arm 640 is adjusted for maximum paddle arm length.

Central support 600 may be an example of, or include aspects of, the corresponding elements described with reference to FIGS. 1 through 5 and 7 through 9. Central support 600 may include support post 605 and clevis 610. The support post 605 may extend upwards from the stem.

Left paddle arm 615 may include left blade 620, left outer tube 630, and left inner tube 635. Left blade 620 may include left blade face 625. Right paddle arm 640 may include right blade 645, right outer tube 655, and right inner tube 660. Right blade 645 may include right blade face 650.

Support post 605, clevis 610, left paddle arm 615, left blade 620, left blade face 625, left outer tube 630, left inner tube 635, right paddle arm 640, right paddle arm 640, right blade 645, right blade face 650, right outer tube 655, right inner tube 660 may be an example of, or include aspects of, the corresponding elements described with reference to FIGS. 1 through 5 and 7 through 9.

Figure 7:
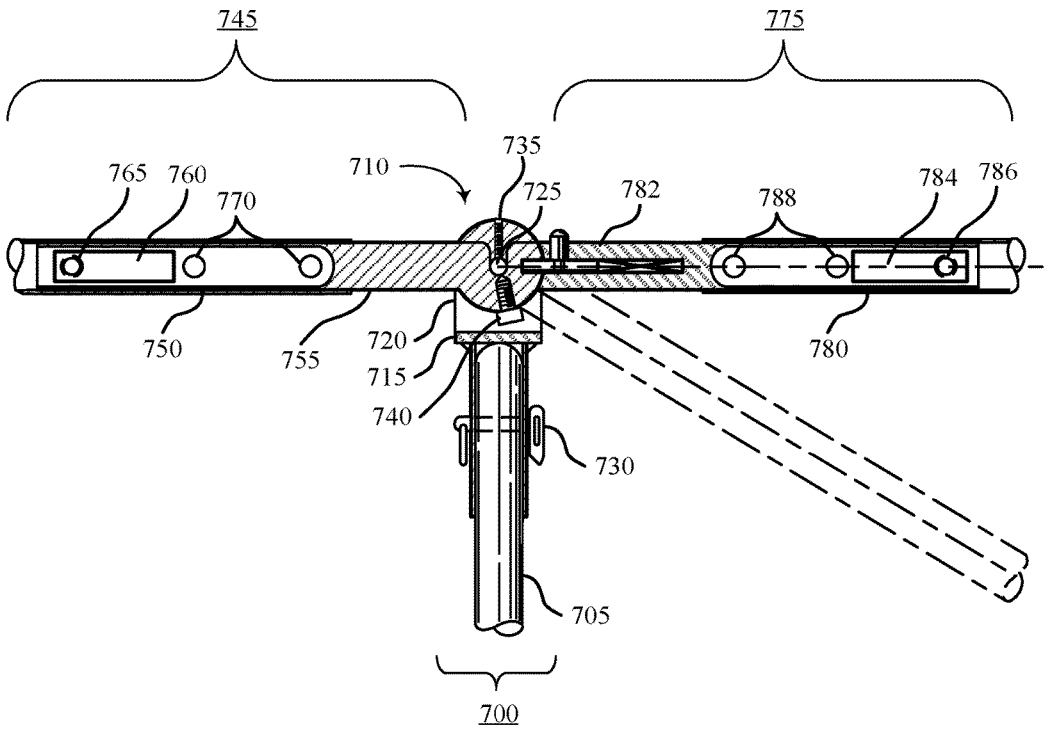
FIG. 7 shows an example of a vertical section through the central hub of the angle oar in accordance with aspects of the present disclosure.

FIG. 7 shows an example of a vertical section through the central hub of the angle oar in accordance with aspects of the present disclosure. The example shown includes central support 700, left paddle arm 745, and right paddle arm 775.

The center support includes the support post 705, the clevis 710, a pivot pin 725 and a clevis lock pin 730. In one embodiment, the pivot pin 725 is held in place by a set screw 735. The portion of the left paddle arm 745 shown includes the left outer tube 750 and the left inner tube 755. A left adjusting spring 760 with a left adjusting button 765 is shown. A plurality of left adjusting holes 770 are shown. A cam head adjustment bolt 740 is shown coupled to the right end of the left inner tube 755. The portion of the right paddle arm 775 shown includes the right outer tube 780 and the right inner tube 782. A right adjusting spring 784 with a right adjusting button 786 is shown. A plurality of right adjusting holes 788 are shown. A sliding bolt lock and a sliding bolt lock spring are located on the right inner tube 782 adjacent to the clevis 710.

Central support 700 may be an example of, or include aspects of, the corresponding elements described with reference to FIGS. 1 through 6, 8, and 9. Central support 700 may include support post 705, clevis 710, pivot pin 725, lock pin 730, set screw 735, and cam head adjustment bolt 740.

The support post 705 may extend upwards from the stem. Support post 705 may be an example of, or include aspects of, the corresponding elements described with reference to FIGS. 1 through 6, 12, 13, and 17.

Clevis 710 may be an example of, or include aspects of, the corresponding elements described with reference to FIGS. 1 through 6, 8, and 17. Clevis 710 may include base plate 715 and front plate 720.

The pivot pin 725 may be at the center of the longitudinal body and oriented transversely to the longitudinal body, wherein each end of the longitudinal body is configured to receive a paddle holder, wherein the body pivots about the pivot pin 725 when the pivot pin 725 is received in a pivotal support.

Pivot pin 725 may be an example of, or include aspects of, the corresponding elements described with reference to FIGS. 8, 9, and 17. Lock pin 730 and set screw 735 may be an example of, or include aspects of, the corresponding elements described with reference to FIG. 8. Cam head adjustment bolt 740 may be an example of, or include aspects of, the corresponding elements described with reference to FIGS. 9 and 10.

Left paddle arm 745 may include left outer tube 750, left inner tube 755, left adjusting spring 760, left adjusting button 765, and left adjusting holes 770.

Left paddle arm 745, left outer tube 750 and left inner tube 755 may be an example of, or include aspects of, the corresponding elements described with reference to FIGS. 1 through 6, 8, and 9. Left adjusting spring 760, left adjusting button 765 and left adjusting holes 770 may be an example of, or include aspects of, the corresponding elements described with reference to FIG. 8.

Right paddle arm 775 may include right outer tube 780, right inner tube 782, right adjusting spring 784, right adjusting button 786, and right adjusting holes 788.

Right outer tube 780 and right inner tube 782 may be an example of, or include aspects of, the corresponding elements described with reference to FIGS. 1 through 6, 8, and 9. Right adjusting spring 784, right adjusting button 786 and right adjusting holes 788 may be an example of, or include aspects of, the corresponding elements described with reference to FIG. 8.

Figure 8:
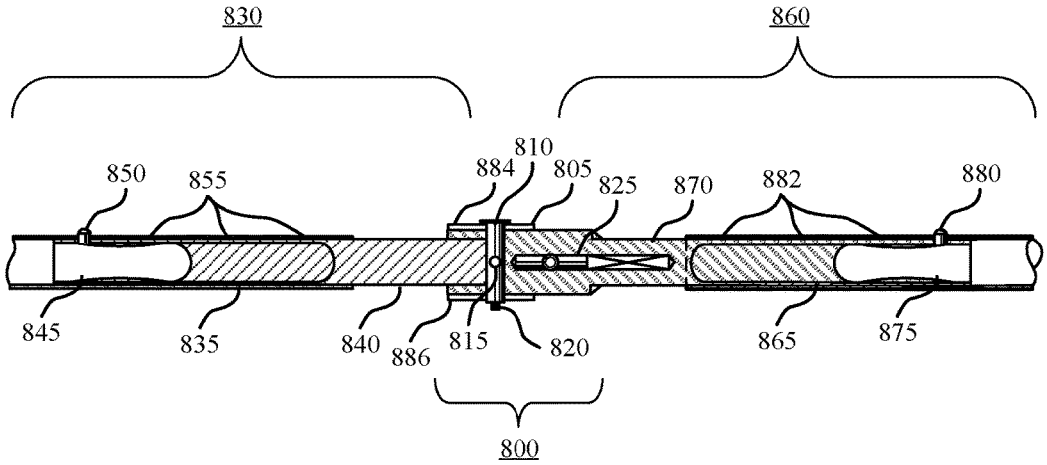
FIG. 8 shows an example of a horizontal section through the central support of the angle oar in accordance with aspects of the present disclosure.

FIG. 8 shows an example of a horizontal section through the central support 800 of the angle oar in accordance with aspects of the present disclosure. The example shown includes central support 800, left paddle arm 830, and right paddle arm 860.

The central support 800 portion including the clevis 805 and pivot pin 810 is shown. In one embodiment, the pivot pin 810 is held in place by a set screw 815. The portion of the left paddle arm 830 shown includes the left outer tube 835 and the left inner tube 840. A left adjusting spring 845 with a left adjusting button 850 is shown. A plurality of left adjusting holes 855 are shown. The portion of the right paddle arm 860 shown includes the right outer tube 865 and the right inner tube 870. A right adjusting spring 875 with a right adjusting button 880 is shown. A plurality of right adjusting holes 882 are shown.

In one embodiment of the invention, the clevis 805 base tube receives and is supported by the support post. The top portion of the clevis 805 includes two vertical sides located outside of the inner tubes. The clevis 805 sides, along with the pivot pin 810, provide support for the paddle arms and allow for rotation of the paddle arms about the pivot pin 810 axis. In one configuration, the sliding bolt lock 825 is moved to its leftmost position. A portion of the sliding bolt lock 825 is received by a sliding bolt lock hole in the cylindrical portion of the left inner tube 840.

The hole for the sliding bolt lock 825 is located so that engagement of the lock will align the longitudinal axes of the left and right paddle arms and prevent them from moving relative to one another. The sliding bolt lock spring is sufficiently tensioned to keep the sliding bolt lock 825 in the leftmost position while allowing for a person to slide the sliding bolt lock 825 to the rightmost position when desired. When the sliding bolt lock 825 is moved to its rightmost position, the right paddle arm 860 rotates clockwise until its rotation is stopped by the cam head adjustment bolt. Alternately, when the sliding bolt lock 825 is moved to its rightmost position, the left paddle arm 830 may be rotated clockwise towards the right paddle arm 860, allowing for a shorter paddle arm profile.

In one embodiment, the paddle arms include a button spring mechanism. On the left paddle arm 830, the left adjusting spring 845 is coupled to the inside of the left inner tube 840. The left adjusting button 850 is coupled to the left adjusting spring 845 so that the left adjusting button 850 extends through one of the left adjusting holes 855, locking the length of the paddle arm. The left adjusting spring 845 holds the left adjusting button 850 in place.

To adjust the length of the left paddle, the left adjusting button 850 is depressed until the button top is below the left outer tube 835, allowing the left outer tube 835 to slide relative to the left inner tube 840. The left outer tube 835 slides to the left or right until the left adjusting button 850 aligns with an alternate left adjusting hole and the left adjusting spring 845 causes the button to extend through the alternate left adjusting hole. The difference between the previous left adjusting hole and the current left adjusting hole is the change in left paddle arm 830 length. The right paddle arm 860 is adjusted in a similar way.

Central support 800 may include clevis 805, pivot pin 810, set screw 815, lock pin 820, and sliding bolt lock 825. Central support 800 may be an example of, or include aspects of, the corresponding elements described with reference to FIGS. 1 through 7, and 9.

Clevis 805 may be an example of, or include aspects of, the corresponding elements described with reference to FIGS. 1 through 7, and 17. Clevis 805 may be connected to pivot pin 810. The pivot pin 810 may be at the center of the longitudinal body and oriented transversely to the longitudinal body, wherein each end of the longitudinal body is configured to receive a paddle holder, wherein the body pivots about the pivot pin 810 when the pivot pin 810 is received in a pivotal support. Pivot pin 810 may be an example of, or include aspects of, the corresponding elements described with reference to FIGS. 7, 9, and 17.

Set screw 815 and lock pin 820 may be an example of, or include aspects of, the corresponding elements described with reference to FIG. 7. Sliding bolt lock 825 may be an example of, or include aspects of, the corresponding elements described with reference to FIG. 9.

Left paddle arm 830 may include left outer tube 835, left inner tube 840, left adjusting spring 845, left adjusting button 850, and left adjusting holes 855. Left paddle arm 830, left outer tube 835 and left inner tube 840 may be an example of, or include aspects of, the corresponding elements described with reference to FIGS. 1 through 7, and 9.

Left adjusting spring 845, left adjusting button 850 and left adjusting holes 855 may be an example of, or include aspects of, the corresponding elements described with reference to FIG. 7.

Right paddle arm 860 may include right outer tube 865, right inner tube 870, right adjusting spring 875, right adjusting button 880, right adjusting holes 882, front outer plate 884, and rear outer plate 886.

Right paddle arm 860, right outer tube 865, and right inner tube 870 may be an example of, or include aspects of, the corresponding elements described with reference to FIGS. 1 through 7, and 9. Right adjusting spring 875, right adjusting button 880 and right adjusting holes 882 may be an example of, or include aspects of, the corresponding elements described with reference to FIG. 7.

Figure 9:
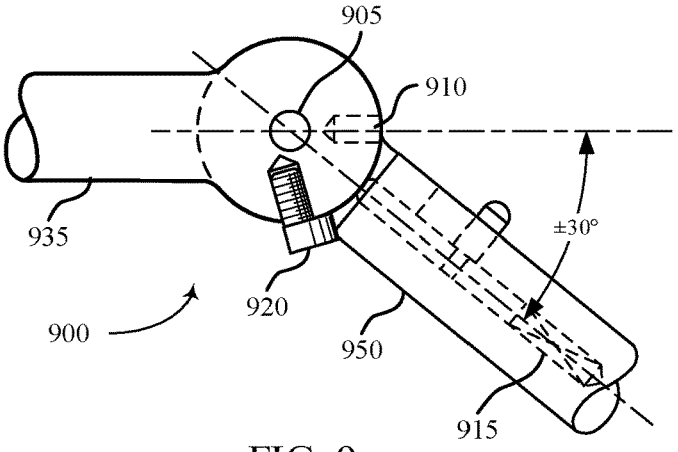
FIG. 9 shows an example of a detail of the central portion of the angle oar in accordance with aspects of the present disclosure.

FIG. 9 shows an example of a detail of the central portion of the angle oar in accordance with aspects of the present disclosure. The central portion of the angle oar is shown with various rotation limits.

In one embodiment, the cam head adjustment bolt 920 has an offset head. The sliding bolt lock 910 is shown in the rightmost position, uncoupling the paddle arms and allowing the right paddle arm (not shown) to be rotated clockwise. The clockwise rotation is stopped when the right inner tube 950 contacts the head of the cam head adjustment bolt 920. In one embodiment, the cam head adjustment bolt 920 is adjusted one quarter turn so that the allowed rotation is approximately 30° when the maximum head overhang of the cam head adjustment bolt 920 contacts the right inner tube 950.

Figure 9A:
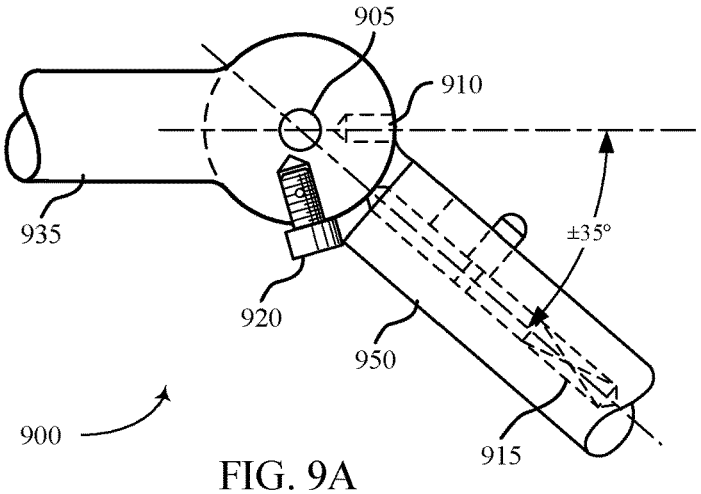
FIG. 9A shows an example of a detail of the central portion of the angle oar in accordance with aspects of the present disclosure.
Figure 9B:
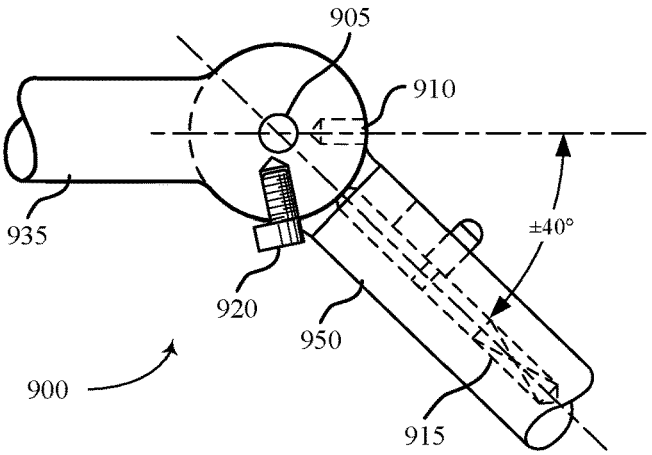
FIG. 9B shows an example of a detail of the central portion of the angle oar in accordance with aspects of the present disclosure.

FIG. 9A shows the cam head adjustment bolt 920 adjusted one half turn so that the allowed rotation angle is increased to approximately 35°. FIG. 9B shows the cam head adjustment bolt 920 adjusted so that the allowed rotation angle is maximized to approximately 40°.

Central support 900 may include pivot pin 905, sliding bolt lock 910, bolt lock spring 915, and cam head adjustment bolt 920. Central support 900 may be an example of, or include aspects of, the corresponding elements described with reference to FIGS. 1 through 8.

The pivot pin 905 may be at the center of the longitudinal body and oriented transversely to the longitudinal body, wherein each end of the longitudinal body is configured to receive a paddle holder, wherein the body pivots about the pivot pin 905 when the pivot pin 905 is received in a pivotal support. Pivot pin 905 may be an example of, or include aspects of, the corresponding elements described with reference to FIGS. 7, 8, and 17.

Sliding bolt lock 910 may be an example of, or include aspects of, the corresponding elements described with reference to FIG. 8. Cam head adjustment bolt 920 may be an example of, or include aspects of, the corresponding elements described with reference to FIGS. 7 and 10.

A left paddle arm (not shown) may include a left outer tube and left inner tube 935. Left paddle arm, left outer tube and left inner tube 935 may be an example of, or include aspects of, the corresponding elements described with reference to FIGS. 1 through 8.

A right paddle arm (not shown) may include a right outer tube (not shown) and right inner tube 950. The right paddle arm, right outer tube, and right inner tube 950 may be an example of, or include aspects of, the corresponding elements described with reference to FIGS. 1 through 8.

Figure 10:
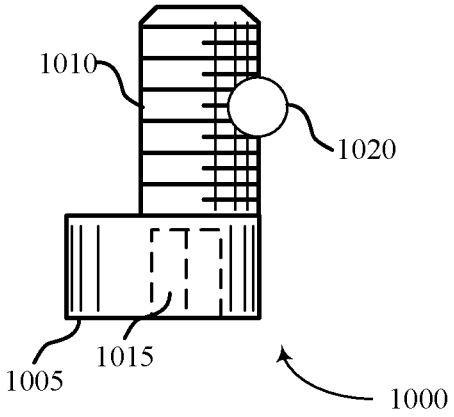
FIG. 10 shows an example of a detail of one embodiment of the cam head adjustment bolt in accordance with aspects of the present disclosure.

FIG. 10 shows an example of a detail of one embodiment of the cam head adjustment bolt 1000 in accordance with aspects of the present disclosure. The example shown includes cam head adjustment bolt 1000.

Figure 10A:
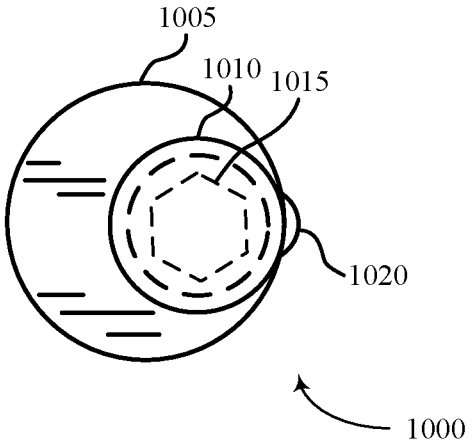
FIG. 10A shows an example of a detail of one embodiment of the cam head adjustment bolt in accordance with aspects of the present disclosure.

A cam head adjustment bolt head 1005 is shown offset from a cam head adjustment bolt shaft 1010. In one embodiment, the cam head adjustment bolt head 1005 is offset from the cam head adjustment bolt shaft 1010 so that the cam head adjustment bolt head 1005 aligns with the cam head adjustment bolt shaft 1010 at a single point, as shown in FIG. 10A.

A thread locking bead 1020 is shown on the cam head adjustment bolt shaft 1010. In this embodiment, the cam head adjustment bolt 1000 diameter is 5/16", the cam head adjustment bolt head 1005 diameter is 5/8", and the cam head adjustment bolt head 1005 thickness is 3/8". In one embodiment, the cam head adjustment bolt head 1005 has a hexagonal socket drive 1015. While the invention herein disclosed has been described by means of specific embodiments, examples and applications thereof, numerous modifications and variations could be made thereto by those skilled in the art without departing from the scope of the invention set forth in the claims.

Cam head adjustment bolt 1000 may be an example of, or include aspects of, the corresponding elements described with reference to FIGS. 7 and 9. Cam head adjustment bolt 1000 may include head 1005, shaft 1010, socket drive 1015, and thread locking bead 1020.

Figure 11:
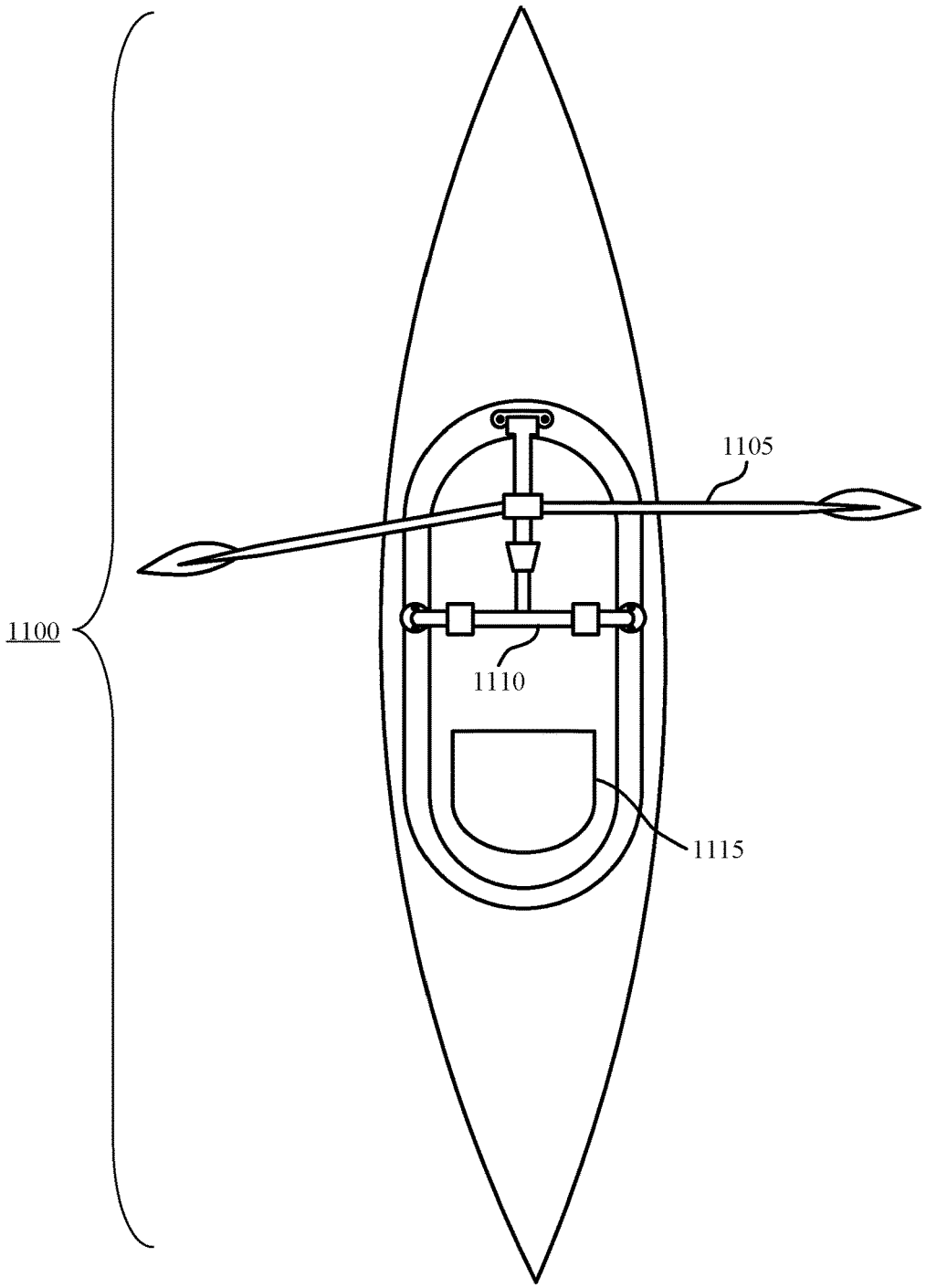
FIG. 11 shows an example of a top view of the angle oar mounted to a sit-in kayak with a hinged mount coupled to the kayak in accordance with aspects of the present disclosure.

FIG. 11 shows an example of a top view of the angle oar 1105 mounted to a sit-in kayak 1100 with a hinged mount 1110 coupled to the kayak 1100 in accordance with aspects of the present disclosure.

Figure 12:
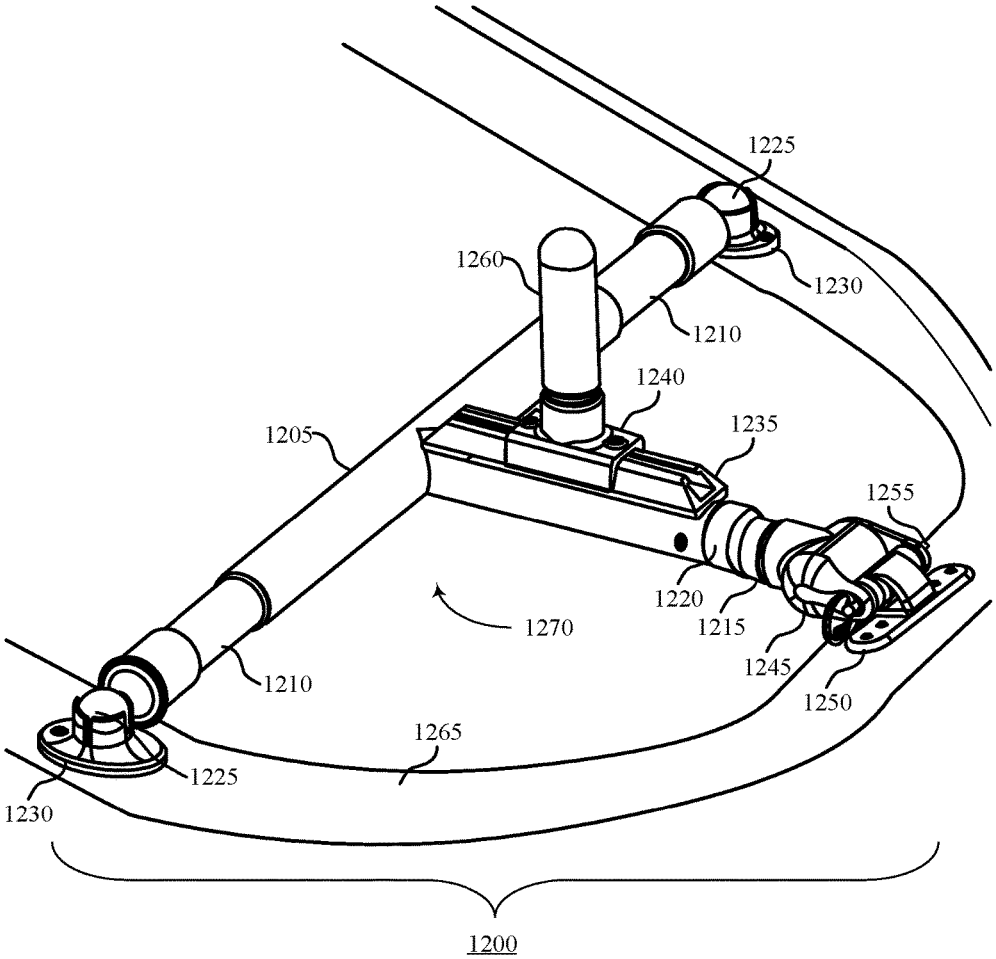
FIG. 12 shows an example of a perspective view of the hinged mount mounted to the kayak in accordance with aspects of the present disclosure.

The hinged mount 1110 is designed for mounting to sit-in kayaks 1100 with a defined 1-2" coaming around the cockpit of the kayak 1100 or sit-in kayaks 1100 with a mostly flat deck area. Generally, the hinged mount 1110 is designed to be supported on each side of the kayak and span across the central portion where the user is sitting. The hinged mount 1110 is a general T-shape oriented horizontally. The angle oar (paddle) 1105 couples to the support post extending generally vertically upward from the stem of the T-shape (as shown in FIG. 12). In the present embodiment the total stem length is adjustable from approximately 12" to 18" and the total flange width is adjustable from approximately 19"-30" to fit a range of sit-in kayaks 1100. In some embodiments the total flange width is adjustable from approximately 20" to 29.5".

The hinged mount 1110 is coupled to the cockpit (or to a deck area of a sit-in kayak) at each end of the T-shape. The end of the stem portion is coupled to the top surface of the rim (coaming) at the front of the cockpit, and each end of the flange sits on (or in some embodiments is coupled to) the proximate side of the cockpit rim, so that the stem is generally aligned with the longitudinal axis of the kayak 1100 and the flange sits across the cockpit in front of the user.

In other words, when the t-shaped body is oriented in a generally horizontal position with the stem facing towards the front of the boat (such that the flange lays generally across the cockpit or sit-on portion), each end of the flange is configured to rest on a portion of a side of the boat with each of the flange ends resting on an opposing side of the boat. In some embodiments the portion of the side of the boat may be generally flat.

The support post extends generally vertically upwards from the stem and is rigidly coupled to the stem and supports the clevis as previously described. In the present embodiment the rigid coupling of the support post includes a track along the top surface of the stem whereby the location of the support post along the stem may be adjusted. The support post may also be removed from the track and other components compatible with the track may be coupled to the hinged mount 1110, e.g. a camera support or a fishing rod support.

Kayak 1100 may be an example of, or include aspects of, the corresponding elements described with reference to FIG. 1 and may include angle oar 1105, hinged mount 1110, and seat 1115. Angle oar 1105 may be an example of, or include aspects of, the corresponding elements described with reference to FIGS. 1 through 6.

The hinged mount 1110 may have a generally t-shaped tubular body including a flange and a stem, wherein the length of the flange and the stem is adjustable and the ends of the flange are configured to rest on opposite sides of the boat cockpit when the body is oriented in a generally horizontal position with the stem facing towards the front of the boat. Hinged mount 1110 may be an example of, or include aspects of, the corresponding elements described with reference to FIGS. 12 and 13.

FIG. 12 shows an example of a perspective view of the hinged mount 1200 mounted to the kayak in accordance with aspects of the present disclosure. The example shown includes hinged mount 1200, support post 1260, coaming 1265, and cockpit 1270.

The hinged mount 1200 includes a t-shaped tubular body 1205. Each flange end of the body 1205 slidably receives a tubular arm 1210. Each arm 1210 is adjustable lengthwise by using the compression fitting 1220. The end of each arm 1210 distal to the body 1205 includes a ball 1225 configured to be received by the socket mount 1230 coupled to the kayak top surface at each side of the cockpit 1270. The socket mount 1230 includes a base coupled to the kayak (by screws or bolts and a flexible gasket in the present embodiment) and an upward-facing socket configured to receive the ball 1225. In the embodiment shown the ball 1225 is a female slip pipe socket with 1" ball manufactured by RAM®, although the ball 1225 may be of any suitable ball 1225 design and/or manufacturer. The ball socket connection is such that the end of the arm 1210 is secured while the user is paddling the kayak, but the arm 1210 may easily be popped out of the socket when needed (e.g. after capsizing or when rotating the mount about the front hinged portion for entry or exit from the cockpit 1270).

The socket mount 1230 provides extra lateral stability but is not required. As previously described in some embodiments the balls 1225 may simply rest on top of the kayak.

The stem end of the t-shaped body 1205 slidably receives a tubular leg 1215. The leg 1215 is also adjustable lengthwise using a compression fitting 1220. Other suitable adjustment mechanisms may be used for the adjustable arms 1210 and legs 1215, for example set screws. The end of the leg 1215 distal from the body 1205 includes a hinge coupler 1245 configured to rotatably couple to the front mount 1250 (which is mounted to the coaming 1265 at the front of the cockpit 1270), forming a hinge.

The hinge allows the hinged mount to rotate from the generally horizontal position upwards towards the bow of the kayak when the ball 1225 ends are removed from the socket mounts 1230, allowing the user to easily enter or exit the kayak. The hinge also allows for mounting flexibility needed for different angles/elevations of the front portion of the coaming 1265 relative to the sides of the coaming 1265, as different kayak types have different coaming geometries. The adjustability of the arms 1210 and leg 1215 also provide flexibility for mounting to different kayaks and also for positioning of the oar when attached to the support post 1260.

The support post 1260 extends upwards from the track adapter 1240, so that the location of the support post 1260 is adjusted by adjusting the track adapter 1240 in the track 1235. The support post 1260 is a generally cylindrical shape, with a rounded end configured to receive the clevis. The length of the support post 1260 is configured for the specific kayak and paddle/oar configuration.

The hinged mount 1200 may include a generally t-shaped tubular body 1205 including a flange and a stem, wherein the length of the flange and the stem is adjustable and the ends of the flange are configured to rest on opposite sides of the boat cockpit 1270 when the body 1205 is oriented in a generally horizontal position with the stem facing towards the front of the boat.

Hinged mount 1200 may be an example of, or include aspects of, the corresponding elements described with reference to FIGS. 11 and 13. Hinged mount 1200 may include body 1205, arms 1210, leg 1215, compression fitting 1220, balls 1225, socket mounts 1230, track 1235, track adapter 1240, hinge coupler 1245, front mount 1250, and pin 1255.

Body 1205 may be an example of, or include aspects of, the corresponding elements described with reference to FIG. 13. Arms 1210 may be an example of, or include aspects of, the corresponding elements described with reference to FIGS. 13 and 15. Leg 1215 may be an example of, or include aspects of, the corresponding elements described with reference to FIG. 13. Balls 1225 may be an example of, or include aspects of, the corresponding elements described with reference to FIG. 13.

The socket mount 1230 may be configured to couple to each side of the cockpit 1270 and wherein the flange ends are configured to be removably coupled to the corresponding mount. The track 1235 may be coupled to an upper side of the stem wherein the support post 1260 is coupled to the track 1235, whereby a location of the support post 1260 is adjustable along the track 1235. Track 1235 may be an example of, or include aspects of, the corresponding elements described with reference to FIG. 13. Track adapter 1240 may be an example of, or include aspects of, the corresponding elements described with reference to FIG. 13.

Hinge coupler 1245 may be an example of, or include aspects of, the corresponding elements described with reference to FIGS. 13, 14, and 15. The front mount 1250 may be configured to couple to a front end of the cockpit 1270 and pivotally couple to an end of the stem, whereby the t-shaped body 1205 may be rotated upwards away from the boat.

Front mount 1250 may be an example of, or include aspects of, the corresponding elements described with reference to FIGS. 14 and 15. Pin 1255 may be an example of, or include aspects of, the corresponding elements described with reference to FIGS. 13, 14, and 15.

The support post 1260 may extend upwards from the stem. Support post 1260 may be an example of, or include aspects of, the corresponding elements described with reference to FIGS. 1 through 7, 13, and 17.

Figure 13:
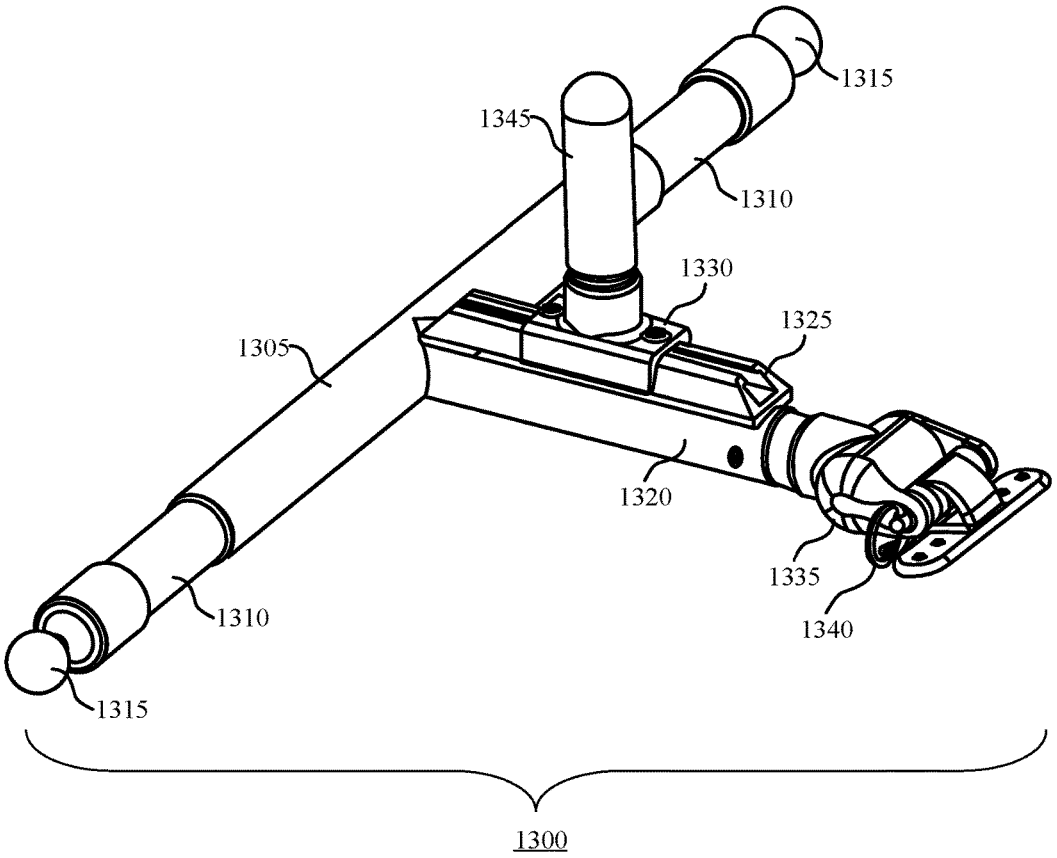
FIG. 13 shows an example of the hinged mount without the mounting portions in accordance with aspects of the present disclosure.

FIG. 13 shows an example of the hinged mount 1300 without the mounting portions (i.e., the front mount and the socket mounts) in accordance with aspects of the present disclosure. The example shown includes hinged mount 1300 and support post 1345.

A longitudinal track 1325 is coupled to an upward-facing portion of a stem 1320 (of the body 1305) proximate to the flange. A track adapter 1330 is slidably coupled to the track 1325, whereby the track adapter 1330 can be adjusted along the track 1325 when the track 1325 coupling is loosened, then fixed in place by tightening the screws.

The hinge coupler 1335 includes the two arms 1310 that receive the pin 1340. The hinged mount without the mounting portions may be moved from kayak to kayak as long as the kayak has at least the front mount coupled to the kayak.

The hinged mount 1300 may have the generally t-shaped tubular body 1305 including a flange and the stem 1320, wherein the length of the flange and the stem 1320 is adjustable and the ends of the flange are configured to rest on opposite sides of the boat cockpit when the body 1305 is oriented in a generally horizontal position with the stem facing towards the front of the boat.

Hinged mount 1300 may be an example of, or include aspects of, the corresponding elements described with reference to FIGS. 11 and 12. Hinged mount 1300 may include body 1305, arm 1310, ball 1315, stem 1320, track 1325, track adapter 1330, hinge coupler 1335, and pin 1340.

Body 1305 may be an example of, or include aspects of, the corresponding elements described with reference to FIG. 12. Arms 1310 may be an example of, or include aspects of, the corresponding elements described with reference to FIGS. 12 and 15. Balls 1315 may be an example of, or include aspects of, the corresponding elements described with reference to FIG. 12.

Stem 1320 may be an example of, or include aspects of, the corresponding elements described with reference to FIG. 12. The track 1325 may be coupled to an upper side of the stem 1320 wherein the support post 1345 is coupled to the track 1325, whereby a location of the support post 1345 is adjustable along the track 1325. Track 1325 may be an example of, or include aspects of, the corresponding elements described with reference to FIG. 12. Track adapter 1330 may be an example of, or include aspects of, the corresponding elements described with reference to FIG. 12.

Hinge coupler 1335 may be an example of, or include aspects of, the corresponding elements described with reference to FIGS. 12, 14, and 15. Pin 1340 may be an example of, or include aspects of, the corresponding elements described with reference to FIGS. 12, 14, and 15. The support post 1345 may extend upwards from the stem. Support post 1345 may be an example of, or include aspects of, the corresponding elements described with reference to FIGS. 1, 3 through 7, 12, and 17.

Figure 14:
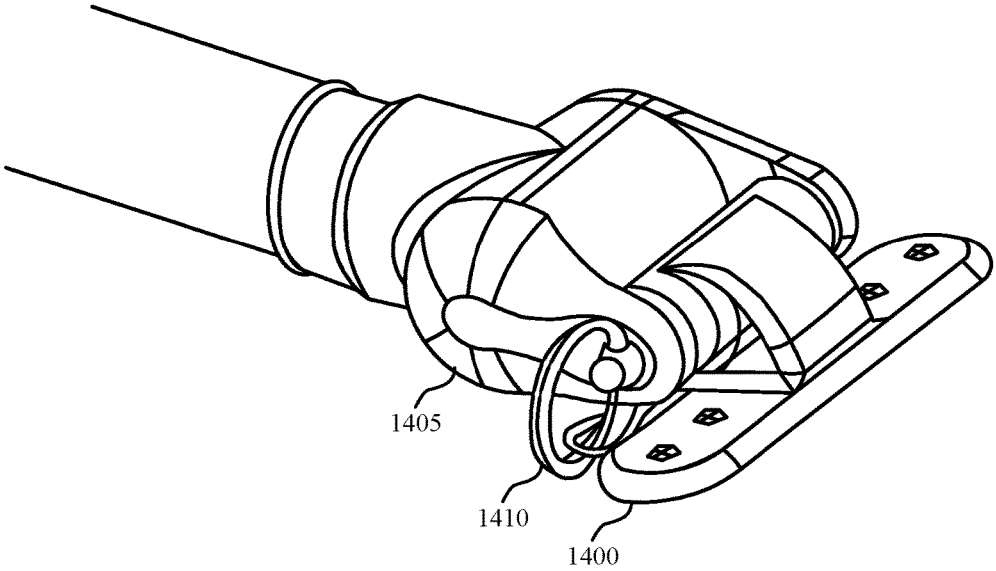
FIG. 14 shows an example of a perspective view of the front hinged connection shown in a connected configuration in accordance with aspects of the present disclosure.

FIG. 14 shows an example of a perspective view of the front hinged connection in a connected configuration in accordance with aspects of the present disclosure. The example shown includes front mount 1400, hinge coupler 1405, and pin 1410.

The front mount 1400 includes a generally flat base including a plurality of holes for fastening to the kayak. In the present embodiment the base includes four countersunk holes, two on each side. The front mount 1400 is coupled to the kayak with bolts or other suitable fastener (corresponding holes may be drilled in the kayak to receive the fastener).

In some examples, a flexible gasket may be installed between the base and the kayak. A horizontal tubular portion extends upwards from the base and includes the pin hole for receiving a pin 1410.

The hinge coupler 1405 may be a general clevis design including two opposing arms, each arm including a hole at the end. The arms are configured such that when the tubular portion of the front mount 1400 is interposed between the arms, the arm holes and the pin hole line up, whereby the pin 1410 is inserted as shown in FIG. 14. The pin 1410 includes a depressible button on the end of the pin 1410 to retain the pin 1410 in the connection and allow for removal of the pin 1410 when depressed. When the pin 1410 is inserted, the hinged mount pivots about the pin 1410 while still being securely mounted to the kayak. When the pin 1410 is removed, the hinged mount can be removed and used on another kayak (as long as the other kayak also has a front mount 1400), and the kayak can be used with a traditional oar if desired.

The front mount 1400 may be configured to couple to a front end of the cockpit and pivotally couple to an end of the stem, whereby the t-shaped body may be rotated upwards away from the boat. Front mount 1400 may be an example of, or include aspects of, the corresponding elements described with reference to FIGS. 12 and 15.

Hinge coupler 1405 may be an example of, or include aspects of, the corresponding elements described with reference to FIGS. 12, 13, and 15. Pin 1410 may be an example of, or include aspects of, the corresponding elements described with reference to FIGS. 12, 13, and 15.

Figure 15:
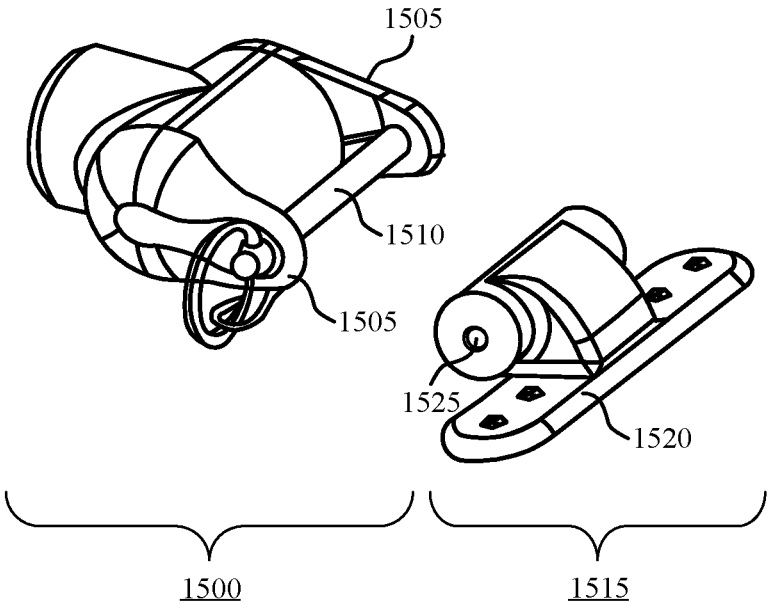
FIG. 15 shows an example of a perspective view of the front hinged connection shown in a connected and unconnected configuration in accordance with aspects of the present disclosure.

FIG. 15 shows an example of a perspective view of the front hinged connection in a connected and unconnected configuration in accordance with aspects of the present disclosure. The example shown includes hinge coupler 1500, pin 1510, and front mount 1515.

Hinge coupler 1500 may be an example of, or include aspects of, the corresponding elements described with reference to FIGS. 12, 13, and 14. Hinge coupler 1500 may include arms 1505. Pin 1510 may be an example of, or include aspects of, the corresponding elements described with reference to FIGS. 12, 13, and 14.

The front mount 1515 may be configured to couple to a front end of the cockpit and pivotally couple to an end of the stem, whereby the t-shaped body may be rotated upwards away from the boat. Front mount 1515 may be an example of, or include aspects of, the corresponding elements described with reference to FIGS. 12 and 14. Front mount 1515 may include base 1520 and pin hole 1525.

Figure 16:
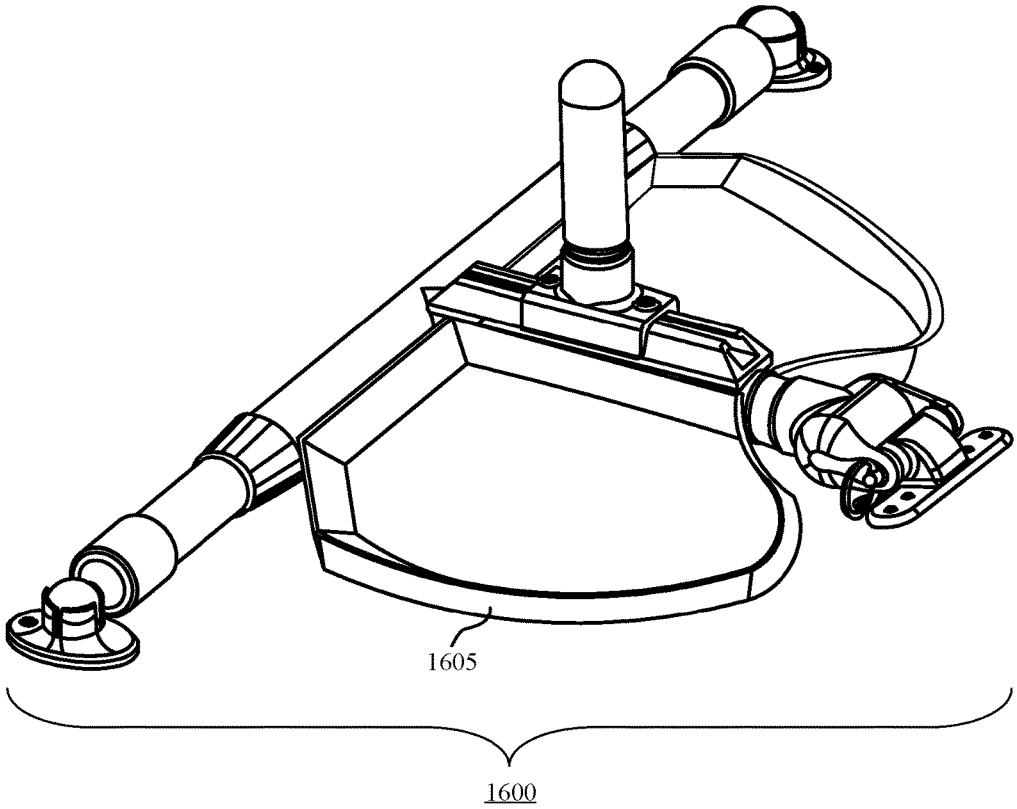
FIG. 16 shows an example of a tray for the hinged mount in accordance with aspects of the present disclosure.

FIG. 16 shows an example of a tray 1605 for the hinged mount 1600 in accordance with aspects of the present disclosure. The tray 1605 is shown installed on the hinged mount 1600. The example shown includes hinged mount 1600 and tray 1605. Hinged mount 1600 may be an example of the hinged mount described with reference to FIGS. 11 through 13.

The tray 1605 fits over the stem of the body and over a portion of the flange and is thereby supported. The track then fits over the tray 1605, whereby the tray 1605 is secured to the body by the fastening of the track to the body. The tray 1605 is made of molded plastic or other suitable material.

The tray 1605 may include a t-shaped center portion configured to be seated on a flange and a stem of a t-shaped mount when the t-shaped mount is mounted to the cockpit in a generally horizontal orientation, wherein the t-shaped center portion is shaped to conform to the outer shape of the center portion.

Figure 17:
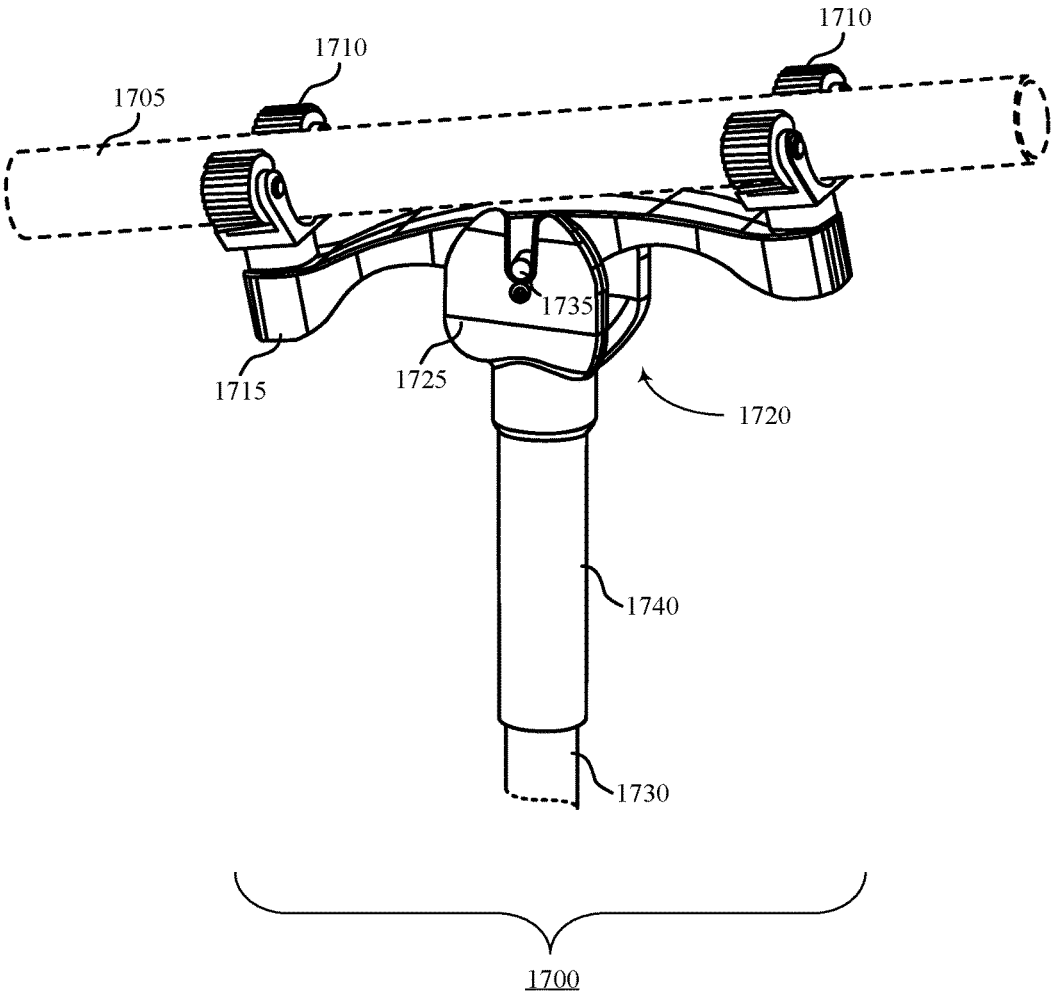
FIG. 17 shows an example of a front perspective view of a mount adapter. The clevis and support post are shown in accordance with aspects of the present disclosure.

FIG. 17 shows an example of a front perspective view of a mount adapter 1700. The example shown includes mount adapter 1700, clevis 1715, and support post 1730 in accordance with aspects of the present disclosure.

The clevis 1715 and support post 1730 are shown in one embodiment of the present invention. The mount adapter 1700 has a generally horizontal symmetrical body with a pivot pin 1735 extending out from the front and back faces at the center of the body. The pin is seated in the notch of the clevis 1715, whereby the mount adapter 1700 can pivot on the pivot pin 1735, similarly to the pivot pins 725 and 810 as previously described. For example, when coupled to the pivot pin the mount adapter 1700 can rotate relative to the clevis 1715. Each end of the mount adapter 1700 is configured to receive a paddle holder 1710. In the embodiment shown in FIG. 17, each paddle holder includes a pair of opposing grips, whereby the paddle shaft is removably held between the grips. In one embodiment, the grips are roller grips. In one embodiment the paddle holder with roller grips is a YAKATTACK® RotoGrip™ paddle holder. In the present embodiment each end of the mount adapter 1700 includes a generally vertical cylindrical opening to receive a cylindrical portion of the paddle holder 1710.

In embodiments using different types of paddle holders 1710 each end of the mount adapter 1700 can be modified to support the specific type of paddle holder 1710. The paddle is then mounted to the mount adapter 1700 using the paddle holders 1710. In this way a conventional straight paddle can be used with the clevis 1715 and support post 1730 as previously described, without having to procure an oar or paddle specifically compatible with the clevis 1715, and support post 1730.

As shown in FIG. 17, the clevis 1715 comprises an upper clevis bracket 1720 coupled to a clevis base tube 1725. The clevis bracket 1720 comprises a general c-shaped channel shape with the channel facing upwards. Each flange of the channel includes a notch configured to receive the pivot pin 1735 of the mount adapter 1700. In some embodiments a lockable device may be incorporated into each notch to allow for more secure retaining of the pivot pin 1735 while still allowing for the pivot pin 1735 to be easily removed from the notch.

In one embodiment a tubular portion 1740 of the clevis bracket 1720 is integrally formed with the clevis bracket 1720 and extends downward from the outside face of the channel shape. In other embodiments the clevis bracket 1720 is rotatable with respect to the tubular portion 1740. The tubular portion 1740 is configured to slide over the support post 1730, whereby the clevis 1715 is removably coupled to the support post 1730.

Mount adapter 1700 is configured to receive paddle arm 1705. Clevis 1715 may be an example of, or include aspects of, the corresponding elements described with reference to FIGS. 1 though 8. Clevis 1715 may include a bracket 1720, base tube 1725, and pivot pin 1735.

The pivot pin 1735 may be at the center of the longitudinal body and oriented transversely to the longitudinal body, wherein each end of the longitudinal body is configured to receive the paddle holder 1710, wherein the body pivots about the pivot pin 1735 when the pivot pin 1735 is received in a pivotal support.

Pivot pin 1735 may be an example of, or include aspects of, the corresponding elements described with reference to FIGS. 7 through 9.

Support post 1730 may be an example of, or include aspects of, the corresponding elements described with reference to FIGS. 1 through 7, 12, and 13.

Figure 18:
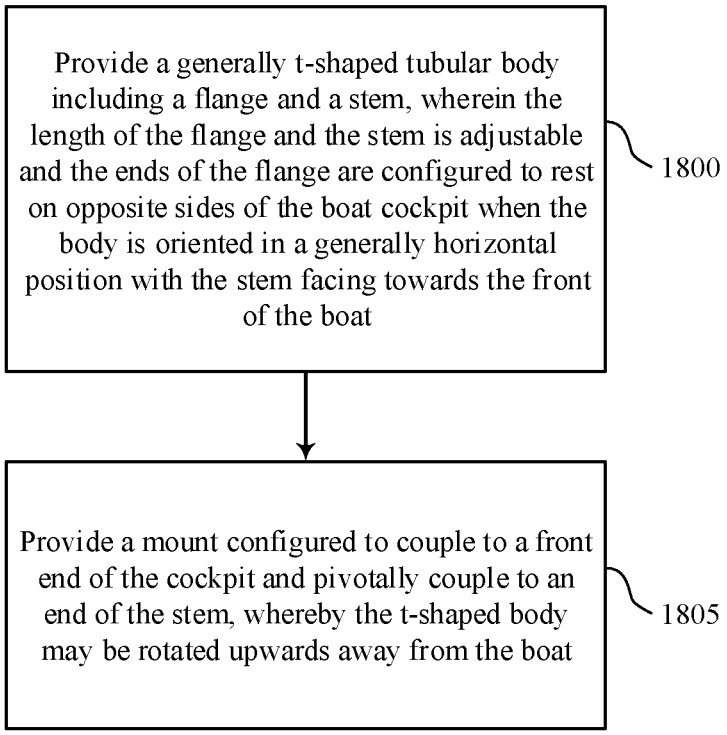
FIG. 18 shows an example of a method of manufacturing a mount for a boat with a cockpit in accordance with aspects of the present disclosure.

FIG. 18 shows an example of a method of manufacturing a mount for a boat with a cockpit in accordance with aspects of the present disclosure. These operations may be performed manually, or by a machine controlled by a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various substeps, or may be performed in conjunction with other operations described herein.

At step 1800, a manufacturing system may provide a generally t-shaped tubular body including a flange and a stem, wherein the length of the flange and the stem is adjustable and the ends of the flange are configured to rest on opposite sides of the boat cockpit when the body is oriented in a generally horizontal position with the stem facing towards the front of the boat.

At step 1805, a manufacturing system may provide a mount configured to couple to a front end of the cockpit and pivotally couple to an end of the stem, whereby the t-shaped body may be rotated upwards away from the boat.

Figure 19:
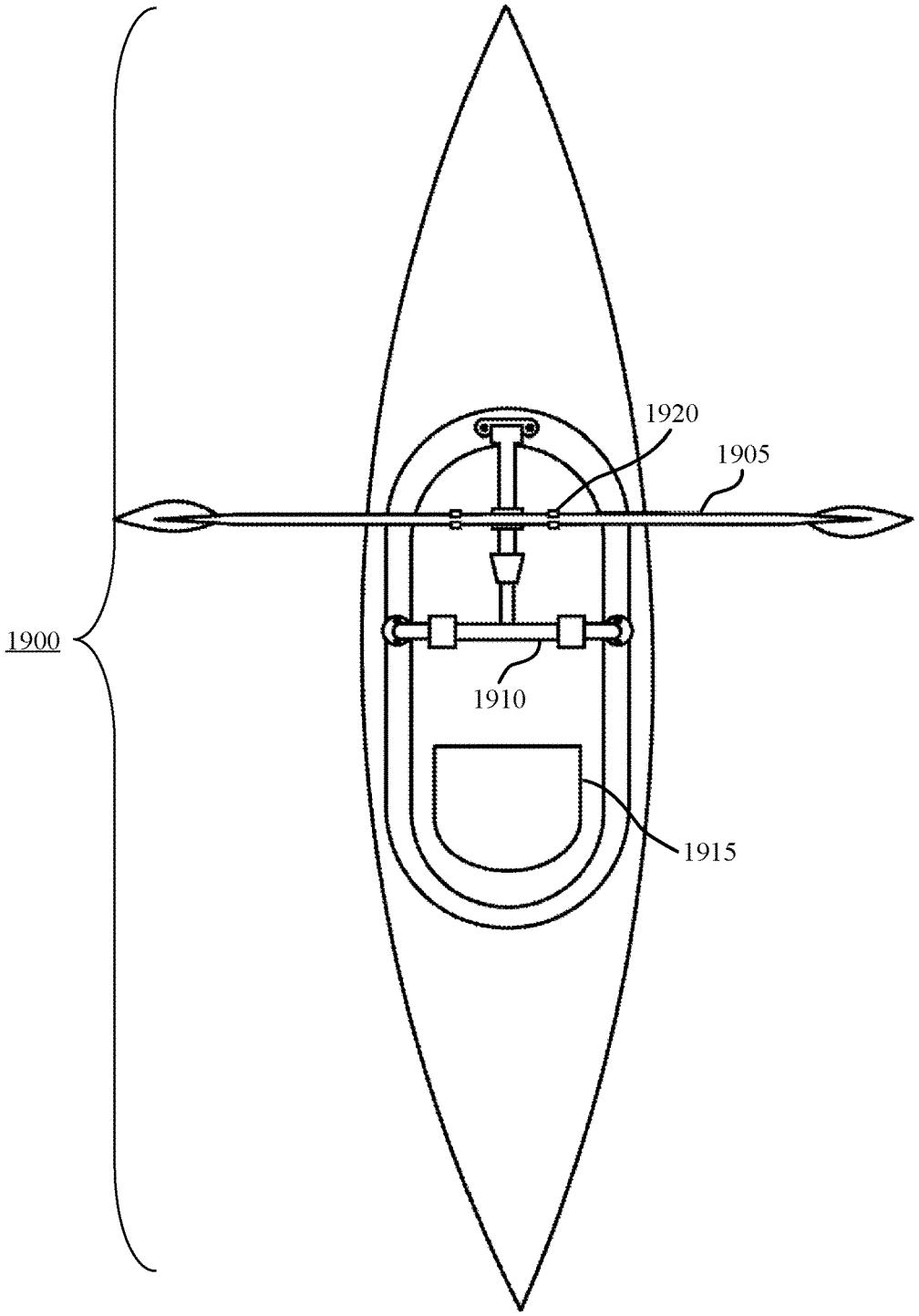
FIG. 19 shows an example of a top view of a straight paddle mounted to a sit-in kayak with a hinged mount coupled to the kayak in accordance with aspects of the present disclosure.

FIG. 19 shows a top view of a straight paddle 1905 mounted to a sit-in kayak 1900 with a hinged mount 1910 coupled to the kayak 1900 in accordance with aspects of the present disclosure.

Hinged mount 1910 may be an example of, or include aspects of, the hinged mount 1110 described with reference to FIG. 11.

Kayak 1900 may be an example of, or include aspects of, the corresponding elements described with reference to FIGS. 11 and 17 and may include straight paddle 1905, hinged mount 1910, and seat 1915, and mount adapter 1920.

Mount adapter 1920 may be an example of, or include aspects of, mount adapter 1700 described with reference to FIG. 17.

In lieu of the angle oar 1105 coupled to a hinged mount, as previously shown in FIG. 11, the kayak 1900 includes the straight paddle 1905 coupled to the mount adapter 1920, as described previously in FIG. 17. The base tube 1740 of the mount adapter 1920 is removably coupled to the support post of the hinged mount 1910 (as shown in FIG. 17).

Figure 20:
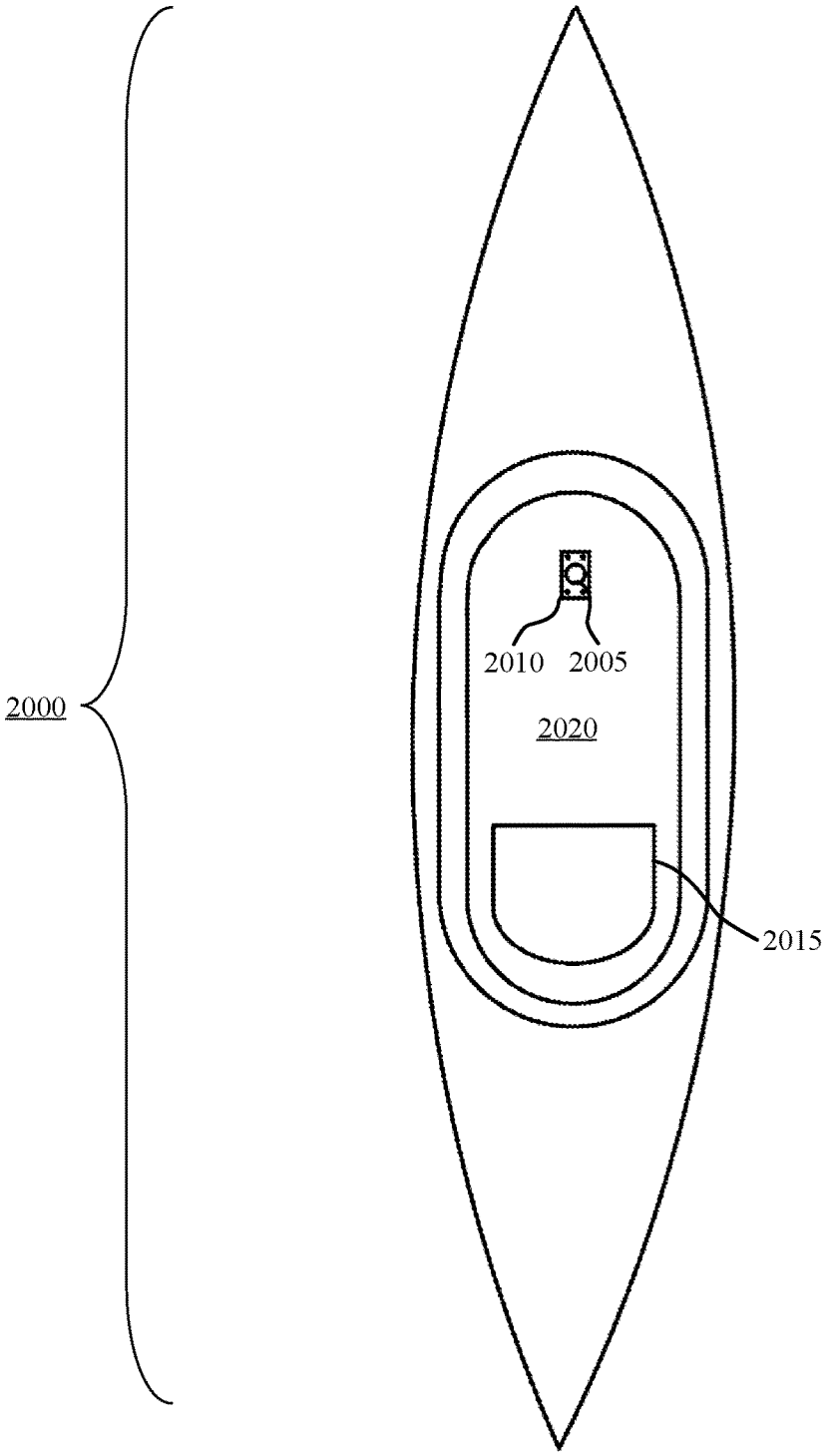
FIG. 20 shows an example of a top view of a sit-on-top kayak with a support post coupled to the kayak in accordance with aspects of the present disclosure.

FIG. 20 shows an example of a top view of a sit-on-top kayak 2000 with a support post 2005 coupled to the kayak 2000 in accordance with aspects of the present disclosure.

The support post 2005 may be an example of, or include aspects of, the support posts described with reference to FIGS. 1-7, 12, 13, 16, and 17.

As shown in FIG. 20, in another embodiment the support post 2005 may be coupled to a floor 2020 of the kayak 2000 instead of to the coaming using the hinged mount as shown in FIGS. 11 and 12. In one embodiment the support post 2005 is coupled to base plate 2010, which is in turn coupled to the kayak floor 2020. The support post 2005 is configured to receive and support the angle oar as shown in FIGS. 1-7 and also to receive and support the mount adapter as shown in FIG. 17.

While the invention herein disclosed has been described by means of specific embodiments, examples and applications thereof, numerous modifications and variations could be made thereto by those skilled in the art without departing from the scope of the invention set forth in the claims.

What is claimed is:

1. A mount for a boat, comprising:

a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat;

a mount configured to couple to a front portion of the boat and pivotally couple to an end of the stem, whereby the t-shaped body may be rotated upwards away from the boat; and a mount configured to couple to each side of the boat, wherein the flange ends are configured to be removably coupled to the corresponding mount, wherein the mounts are socket mounts and the flange ends include a ball configured to fit in the socket.

2. A system for human-powered boat propulsion including a boat and a paddle, the system further comprising:

a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat;

a mount configured to couple to a front portion of the boat and pivotally couple to an end of the stem, whereby the t-shaped body may be rotated upwards away from the boat; and a mount configured to couple to each side of the boat and wherein the flange ends are configured to be removably coupled to the corresponding mount, wherein the mounts are socket mounts and the flange ends include a ball configured to fit in the socket.

3. A method of manufacturing a mount for a boat, the method comprising:

providing a generally t-shaped tubular body including a flange and a stem, wherein a length of the flange and the stem is adjustable and, when the body is oriented in a generally horizontal position with the stem facing towards the front of the boat, each end of the flange is configured to rest on a generally flat portion of a side of the boat, wherein the flange ends rest on opposing sides of the boat;

providing a mount configured to couple to a front portion of the boat and pivotally couple to an end of the stem, whereby the t-shaped body may be rotated upwards away from the boat; and providing a mount configured to couple to each side of the boat and wherein the flange ends are configured to be removably coupled to the corresponding mount, wherein the mounts are socket mounts and the flange ends include a ball configured to fit in the socket.

* * * * *